US005518982A

United States Patent [19]

Inagaki et al.

[11] Patent Number: 5,518,982

[45] Date of Patent: May 21, 1996

[54] THERMOSENSITIVE RECORDING MEDIUM AND COLOR DEVELOPABILITY-IMPROVING AGENT THEREFOR

[75] Inventors: Masaji Inagaki; Kikuo Tsuchiya, both of Hyogo; Ayuri Miyake, Osaka; Shingo Araki, Hyogo, all of Japan

[73] Assignee: Dainippon Ink and Chemicals, Inc., Tokyo, Japan

[21] Appl. No.: 123,263

[22] Filed: Sep. 20, 1993

[30] Foreign Application Priority Data

Sep. 22, 1992 [JP] Japan ..... 4-252783

[51] Int. Cl.[6] ..... B41M 5/40

[52] U.S. Cl. ..... 503/208; 503/209; 503/225

[58] Field of Search ..... 503/208, 209, 503/225; 106/22 A

[56] References Cited

U.S. PATENT DOCUMENTS

| | | | |
|---|---|---|---|
| 4,471,074 | 9/1984 | Iwakura et al. . | |
| 4,531,140 | 7/1985 | Suzuki et al. . | |
| 4,672,401 | 6/1987 | Yamada et al. . | |
| 4,764,500 | 8/1988 | Araki et al. . | |
| 4,992,411 | 2/1991 | Ohkura | 503/200 |
| 4,999,332 | 3/1991 | Okumura et al. | 503/209 |

FOREIGN PATENT DOCUMENTS

| | | | |
|---|---|---|---|
| 57-89994 | 6/1982 | Japan | 503/208 |
| 2-193971 | 6/1992 | Japan | 503/209 |
| 2-226319 | 7/1992 | Japan | 503/209 |

*Primary Examiner*—Bruce Hess

*Attorney, Agent, or Firm*—Armstrong, Westerman Hattori, McLeland & Naughton

[57] ABSTRACT

A thermosensitive recording medium comprising a thermosensitive recording layer containing an electron-donating color forming substance, an electron-accepting substance, and a color developability-improving agent is disclosed, said color developability-improving agent being a solid solution composed of two or more compounds containing at least one color developability-improving compound and having a single intrinsic melting point of not less than room temperature, preferably 60° C. or higher. The recording medium exhibits well-balanced performance among color developing sensitivity, static color developability, image stability, and stability before recording.

8 Claims, 4 Drawing Sheets

THERMOSENSITIVE RECORDING MEDIUM AND COLOR DEVELOPABILITY-IMPROVING AGENT THEREFOR

FIELD OF THE INVENTION

This invention relates to a thermosensitive recording medium having improved color developing performance, particularly color development sensitivity, static color developability, image preservability, and stability before recording, without suffering from prominent defects.

BACKGROUND OF THE INVENTION

Thermosensitive recording media containing an electron-donating color-forming substance and an electron-accepting substance which, on heating, undergo a color formation reaction to form a color image are widely used because of their practical convenience as paper for facsimiles and word processors, POS labels, printer paper for various instruments, and cards. With broadening of application of thermosensitive recording media, there has been an increasing demand for suitability to high-speed recording and high durability. In particular, the demands for improvements in sensitivity and preservability of thermosensitive recording media have ever been increasing.

To meet the demands, hundreds of substances have been studied to date as color developability-improving agents. Among them, benzyl oxalate derivatives, benzylbiphenyl (see JP-A-60 -82382 corresponding to EP-B-164417 and U.S. Pat. No. 4,672,401), benzyloxynaphthalene (see JP-A-58-87094 corresponding to U.S. Pat. No. 4,471,074 and GB Patent 2112951B), ethylene glycol diphenyl ether derivatives (see JP-A-60-56588 corresponding to EP-B-141170 and U.S. Pat. No. 4,531,140), m-terphenyl (see JP-A-57-89994), and so forth have been widely put to practical use. However, having their several merits and demerits, none of them satisfies both the requirements for high sensitivity and high preservability at a time. Hence, it has been demanded to develop a color developability-improving agent excellent in sensitivity and preservability.

SUMMARY OF THE INVENTION

An object of the present invention is to provide a color developability-improving agent with high sensitivity and excellent preservability for use in thermosensitive recording media.

Another object of the present invention is to provide a thermosensitive recording medium with well-balanced color development performance.

In the light of the foregoing circumstances, the present inventors have conducted extensive investigations and as a result have found that a solid solution which is a mixed substance composed of a plurality of compounds containing at least one compound having color developability-improving action and has a single intrinsic melting point of at least room temperature (i.e., 20° C.), preferably 60° C. or higher, and more preferably 90° C. or higher, functions as a color developability-improving agent providing a thermosensitive recording medium excellent in color developability and free from outstanding defects.

The present invention relates to a thermosensitive recording medium comprising a thermosensitive recording layer containing an electron-donating color forming substance (hereinafter referred to as a color former), an electron-accepting substance (hereinafter referred to as a color developer), and a color developability-improving agent, wherein said color developability-improving agent is a solid solution which is a mixture composed of two or more compounds containing at least one color developability-improving compound and having a single intrinsic melting point of not less than room temperature.

The present invention further relates to the above-mentioned color developability-improving agent.

DETAILED DESCRIPTION OF THE INVENTION

Figure 1:
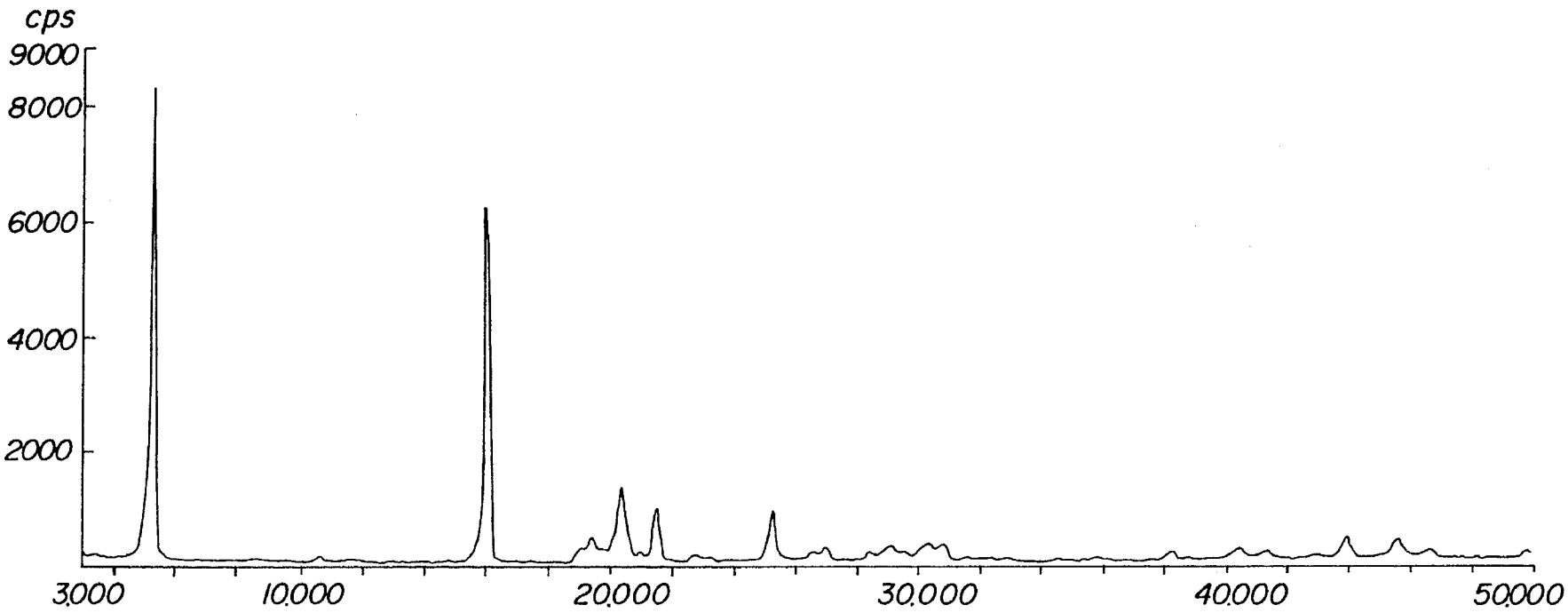
FIG. 1 is a powder X-ray diffraction pattern of two-component solid solution (1) prepared in Preparation Example 1.
Figure 2:
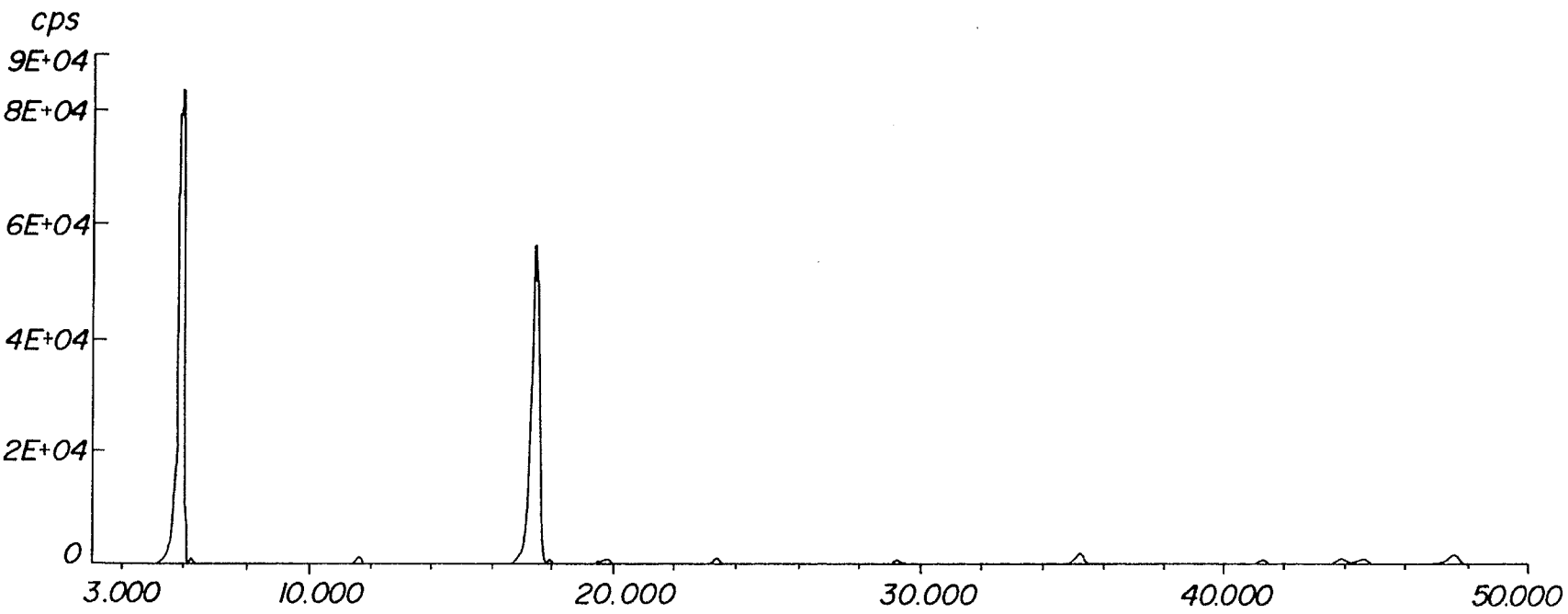
FIGS. 2 and 3 is each a powder X-ray diffraction pattern of an individual component constituting solid solution (1).
Figure 3:
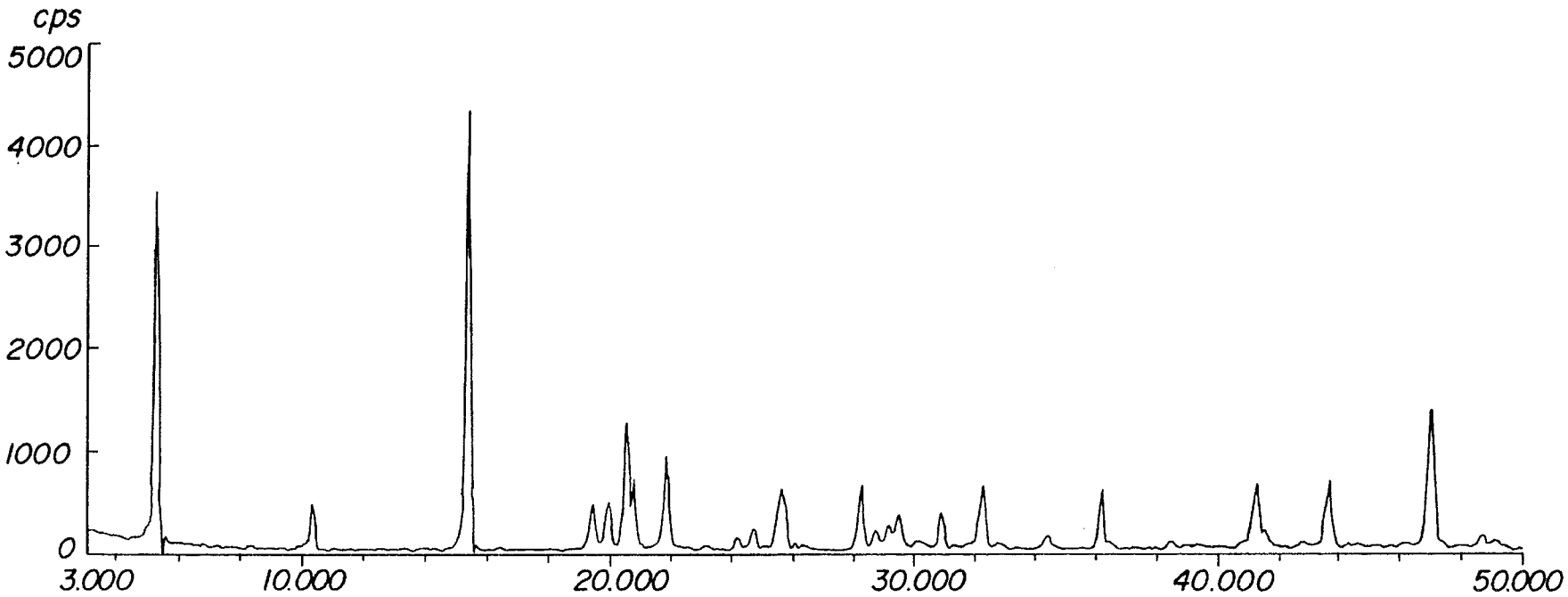
Figure 4:
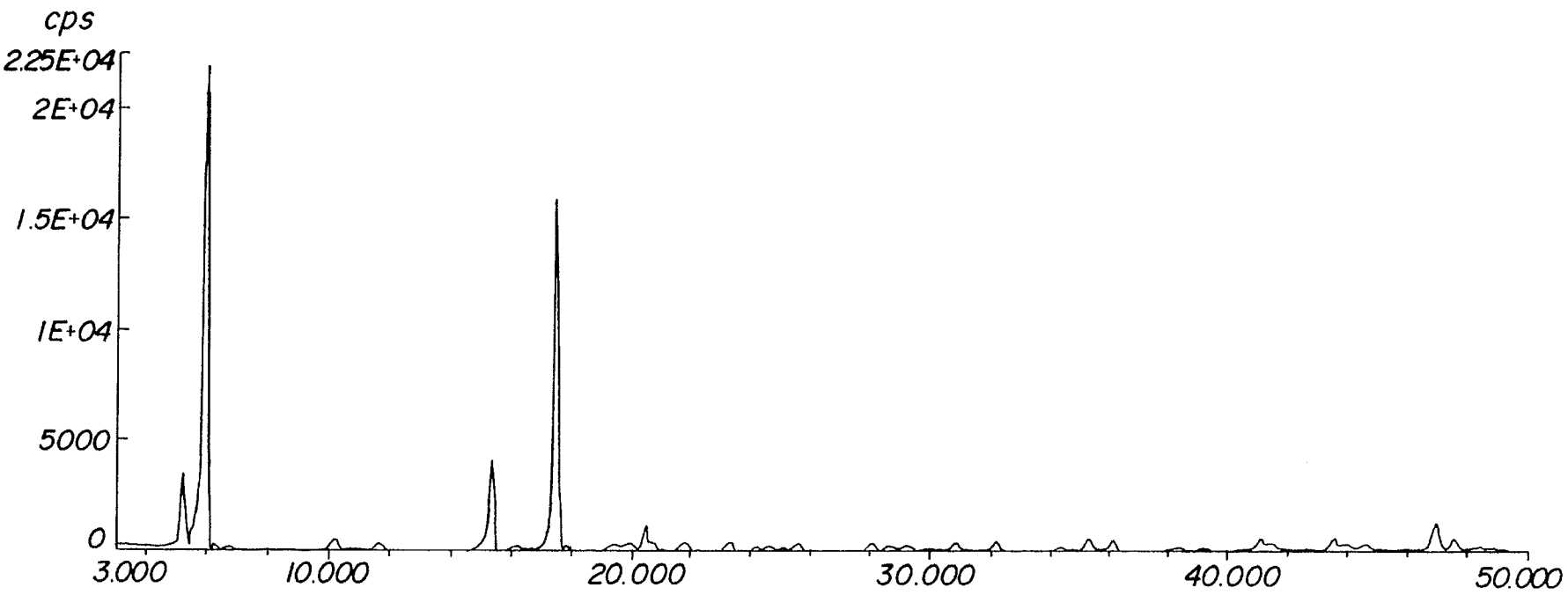
FIG. 4 is a powder X-ray diffraction pattern of a mere mixture of the two components which constitute solid solution (1).

The present invention is characterized by using a plurality of compounds in the form of a solid solution as a color developability-improving agent. In using a single compound crystal as a color developability-improving agent as in conventional techniques, since any of the conventionally proposed compounds has its own demerits, failing to satisfy all the requirements of sensitivity, static color developability, image preservability, and stability before recording (recording performance preservability), the resulting thermosensitive recording medium has unbalanced performance properties. Where a mere mixture of two or more single compound crystals, a drop of a melting point takes place in general, resulting in a reduction in image sharpness or causing background fog. To the contrary, a solid solution of two or more components has an intrinsic melting point and an intrinsic crystal form and therefore shows sharp melting behavior and manifests the merits of the individual components while mutually compensating for the demerits without inducing any prominent disadvantages. Such an advantage tends to become conspicuous as the melting point of a solid solution increases. From this viewpoint, the melting point of the solid solution is preferably 60° C. or higher and more preferably 90° C. or higher.

According to the present invention, a color developability-improving agent whose function cannot be fully performed as expected primarily due to its low melting point may be converted to a satisfactory color developability-improving agent having an elevated melting point by being combined with other appropriate compounds in the form of a solid solution. Taking for an instance, dibenzyl oxalate was ever employed as a color developability-improving agent with its relative cheapness and its having a melting point of about 80° C. being taken advantage of. However, it is no longer satisfactory in these days of increased demands. This dibenzyl oxalate can have its melting point increased and its color developability improved by being converted into a solid solution with other compounds without greatly impairing the economic advantage.

The terminology "solid solution" as used throughout the specification and claims for the sake of convenience is not deemed to be used in its strict meaning. For example, the solid solutions as referred to herein include those sometimes called "mixed crystals". Therefore, whether or not some mixed substance is a "solid solution" as meant in the present invention should be judged taking the agreement of the substance with the present invention in object, action, effect, and the like into consideration.

What is required for the color developability-improving agent according to the present invention is to have a single intrinsic melting point, preferably 60° C. or higher, and more preferably 90° C. or higher, and an intrinsic crystal form. Examples of suitable color developability-improving agents are solid solutions composed of two or more organic compounds which have conventionally been used as a color developability-improving agent, have similar chemical structures, and have relatively strong mutual intermolecular force.

Specific examples of such solid solutions include those composed of two or more compounds selected from aliphatic dibasic acid esters, such as (1) a two-component solid solution composed of di-p-chlorobenzyl oxalate and dibenzyl oxalate, (2) a two-component solid solution composed of di-p-chlorobenzyl oxalate and di-p-methylbenzyl oxalate, (3) a two-component solid solution composed of dibenzyl oxalate and di-p-methylbenzyl oxalate, (4) a two-component solid solution composed of diphenacyl glutarate and di-p-methylbenzyl oxalate, (5) a two-component solid solution composed of diphenacyl thiodipropionate and diphenacyl glutarate, and (6) a three-component solid solution composed of dibenzyl oxalate, di-p-methylbenzyl oxalate and p-chlorobenzyl oxalate; those composed of two or more compounds selected from benzylbiphenyls, such as (7) a two-component solid solution composed of p-benzylbiphenyl and p-(4-methylbenzyl)biphenyl, (8) a two-component solid solution composed of p-benzylbiphenyl and p-(4-chlorobenzyl)biphenyl, and (9) a two-component solid solution composed of p-(4-methylbenzyl)biphenyl and p-(4-chlorobenzyl)biphenyl; those composed of two or more compounds selected from benzyloxynaphthalenes, such as (10) a two-component solid solution composed of β-benzyloxynaphthalene and β-(4-methylbenzyl)oxynaphthalene, (11) a two-component solid solution composed of β-benzyloxynaphthalene and β-(4-chlorobenzyl)oxynaphthalene, and (12) a two-component solid solution composed of β-(4-methylbenzyl)oxynaphthalene and β-(4-chlorobenzyl)oxynaphthalene; and those composed of two or more compounds selected from ethylene glycol diphenyl ethers, such as (13) a two-component solid solution composed of diphenoxyethane and ethylene glycol di-m-tolyl ether.

Additionally, effectiveness of the following solid solutions has been recognized.

(1) Solid Solutions of Aliphatic Dibasic Acid Esters:

Di-m-methylbenzyl oxalate/dibenzyl oxalate

Di-o-chlorobenzyl oxalate/di-m-methylbenzyl oxalate

Di-p-methoxyphenyl malonate/di-p-benzylphenyl malonate

Di-p-chlorophenyl malonate/di-p-methoxyphenyl malonate

Di-p-chlorophenyl succinate/di-3,5-dimethylphenyl succinate

Di-p-chlorophenyl succinate/di-p-benzylphenyl succinate

Di-m-methylphenyl adipate/diphenyl adipate

Di-p-methylphenyl adipate/diphenyl adipate (2) Solid Solutions of Benzylbiphenyls:

Benzylbiphenyl/p-(2-chlorobenzyl)biphenyl p-(4-Methylbenzyl)biphenyl/p-(2-chlorobenzyl)biphenyl (3) Solid Solutions of Benzyloxynaphthalenes:

β-Benzyloxynaphthalene/β-(3-methylbenzyl)oxynaphthalene

β-(3-Chlorobenzyl)oxynaphthalene/β-(3-methylbenzyl)oxynaphthalene (4) Solid Solutions of Ethylene Glycol Diphenyl Ethers:

Diphenoxyethane/ethylene glycol di-o-tolyl ether

Ethylene glycol di-m-chlorophenyl ether/ethylene glycol di-o-tolyl ether

Some of the components constituting these solid solutions exhibit a little or no activity as a color developability-improving agent. As a matter of course, solid solutions containing such components are included in the scope of the present invention.

Compounds which can be combined with at least one compound having color developability-improving action to form a solid solution are selected from those having a molecular size close to that of the compound having color developability-improving action and inducing mutual intermolecular attraction with the latter attributed to Van der Waal's force, electric force, etc. between the molecular skeletons or atomic groups.

The proportion of each component constituting the solid solution is arbitrarily selected from the range of from 1 to 99% by weight. A preferred ratio of the constituent components is an equimolar ratio.

The solid solutions may be prepared by various processes. In general, they can be obtained by a dissolution-recrystallization process in which two or more components are dissolved in a solvent while hot followed by cooling to reprecipitate or a melting-resolidification process in which two or more components are melted by heating followed by cooling to resolidify.

Formation of a solid solution can be confirmed by powder X-ray diffractometry using a CuKα ray. The diffraction pattern of a solid solution is distinguishable either from those of the individual constituent components or from that of a mere mixture of the components. In a more convenient way, formation of a solid solution may be confirmed by the melting point as measured with a differential scanning calorimeter. Solid solution (1) prepared in Preparation Example 1 hereinafter described affords a typical example in which differences in diffraction patterns clearly appear. If differences in diffraction patterns are not so distinguishable as in the case of solid solution (1), whether or not a mixed substance in question has a single melting point gives an important clue because it does meet the purpose of the present invention to make a color developability-improving agent have a single melting point.

The color former which can be used in the present invention is not particularly limited and includes fluoran derivatives, phthalide derivatives, phenoxazine derivatives, phenothiazine derivatives, rhodamine lactam derivatives, Leuco Auramine derivatives, triphenylmethane derivatives, spiropyran derivatives, and the like.

Specific examples of the color formers are 3-(N,N-diethylamino)-6-chlorofluoran, 3-N-cyclohexylamino-6chlorofluoran, 3-(N,N-diethylamino)-7-chlorofluoran, 3-(N,N-diethylamino)-7,8-benzofluoran,3 -(N,N-diethylamino)-6-methyl- 7-chlorofluoran, 3-pyrrolidino-6-methyl-7-anilinofluoran, 3 -(N,N-diethylamino)-7-o-chloroanilinofluoran, 3-(N-methyl-N-cyclohexylamino)-6-methyl-7-anilinofluoran, 3-(N,N-diethylamino)-5-methyl-7-(N,N-dibenzylamino)fluoran, 3-(N-ethyl-N-propylamino)-6-methyl-7-anilinofluoran, 3-(N,N-diethylamino)-6-methyl-7-(2,4-dimethylanilino)fluoran,3 -(N,N-diethylamino)-7-(o-fluoroanilino)fluoran, 3-(N,N-dibutylamino)- 7-(o-fluoroanilino)fluoran, 3-N-cycloheptylamino-7-(N,N-dibenzylamino)fluoran, 3-(N,N-diethylamino)-7-(N-ethylanilino)fluoran, 3-(N-ethyl-N-cyclohexylamino)-7-anilinofluoran, 3-(N,N-diethylamino)-7-(N,N-dibenzylamino)fluoran, 3-(N,N-diethylamino)-7-anilinofluoran, 3-(N,N-diethylamino)-6-methyl-7-anilinofluoran, 3-(N-ethyl-N-tetrahydrofurfurylamino)-6-methyl-7-anilinofluoran, 3-(N-ethyl-N-isobutylamino)-6-methyl-7-anilinofluoran, 3-(N,N-diethylamino)-7-N-n-octylaminofluoran,3-(N,N-diethylamino)-7 -m-trifluoromethylanilinofluoran, 3-(N,N-diethylamino)-6-chloro- 7-anilinofluoran, 3-(N-ethyl-N-isoamylamino)-6-methyl-7-anilinofluoran, 3-(N,N-dibutylamino)-6-methyl-7-anilinofluoran, 3-(N,N-dibutylamino)-7-o-chloroanilinofluoran, 3-(N,N-diethylamino)-6,8-dimethylfluoran,3-(N-ethyl-N-isoamylamino)- 7,8-benzofluoran, 3-(N-ethyl-p-toluidino)-6-methyl-7 -anilinofluoran, 3-(N-ethyl-p-toluidino)-7 -N-methylanilinofluoran,3-(N-ethyl-p-toluidino)-7-methylfluoran, 3-(N,N-diethylamino)-7-methylfluoran,3-(N,N-dimethylamino)-7-methylfluoran, 3-(N-methyl-N-butylamino)-6-methyl-7-anilinofluoran, 3-(N,N-diamylamino)-6-methyl-7-anilinofluoran, 3-methoxyamino-6-methoxyfluoran, 3-(N,N-diethylamino)-7-t-butylfluoran, 3-(N,N-diethylamino)-6-methylfluoran, 3 -(N-methyl-N-amylamino)-6-methyl-7-anilinofluoran, 3 -(N-ethyl-N-amylamino)-6-methyl-7-anilinofluoran,3-(N-ethyl-p-toluidino)- 6-methyl-7-p-toluidinofluoran, 3-(N,N-diethylamino)-7-o-carbomethoxyanilinofluoran, 3-piperidino-6-methyl-7-anilinofluoran, 3-(N-ethyl-N-ethoxypropylamino)-6-methyl-7-anilinofluoran, 3,3-bis(p-dimethylaminophenyl)phthalide, 3,3 -bis(p-dimethylaminophenyl)-6-aminophthalide, 3,3 -bis(p-dimethylaminophenyl)-6-nitrophthalide, 3,3 -bis(p-dimethylaminophenyl)-6-dimethylaminophthalide, 3-(4 -diethylaminophenyl)-3-(1-ethyl-2-methylindol-3-yl)phthalide, 3,3-bis(1-n-butyl-2-methylindol-3-yl)phthalide, 3,3-bis(1 -ethyl-2-methylindol-3-yl)phthalide, 3,3-bis(1-n-octyl-2 -methylindol-3-yl)phthalide,3-(4-diethylamino-2-ethoxyphenyl)-3-(1-ethyl-2-methylindol-3-yl)-4-azaphthalide, 3-(4-N-cyclohexyl-N-methylamino-2-methoxyphenyl)-3-(1-ethyl-2 -methylindol-3-yl)-4-azaphthalide, 3,6-bis(diethylamino)fluoran-γ-anilinolactam, 3,6-bis(diethylamino)fluoran-γ-(p-nitro)anilinolactam, 3,6-bis(diethylamino)fluoran-γ-(o-chloro)anilinolactam, 3,7-bis(dimethylamino)-10 -benzoylphenothiazine, tris(4-dimethylaminophenyl)methane, N-butyl-3-[bis[4-(N-methylanilino)phenyl]methyl]carbazole, 1,3,3 -trimethylindoline-2,2'-spiro-6'-nitro-8'-methoxybenzopyran,3 -methyl-spiro-dinaphthopyran, 3-ethyl-spiro-dinaphthopyran, 3 -benzyl-spiro-dinaphthopyran, 3,6,5'-tris(dimethylamino)-fluorene-9-spiro-1'-(3'-isobenzofuran), 2,2-bis [4-[6 '-(N-cyclohexyl-n-methylamino)-3'-methylspiro(phthalide-3,9' -xanthen)-2'-ylamino]phenyl] propane, 3-(N,N-diethylamino)-6 -chloro-(γ-chloropropylamino)fluoran, 3-(N,N-diethylamino)-6 -chloro-7-(β-ethoxyethylamino)fluoran, 3-(N-ethyl-N-isoamylamino)-6-methyl-7-anilinofluoran, and 2-anilino-3 -methyl-6-(N-methyl-N-n-propylamino)fluoran.

Preferred of them are 3-(N,N-diethylamino)-6-methyl-7-anilinofluoran, 3-(N,N-dibutylamino)-6-methyl-7-anilinofluoran, 3-(N-ethyl-N-isoamylamino)-6-methyl-7-anilinofluoran, 3 -(N-methyl-N-cyclohexylamino)-6-methyl-7-anilinofluoran, and 3 -(N,N-diamylamino)-6-methyl-7-anilinofluoran.

These color formers may be used either individually or in combination of two or more thereof.

The color developer which can be used in the present invention is selected from those which are solid at room temperature and liquefied on heating to about 60° to 180° C. to open the lactone ring of the above-enumerated color former thereby developing a color and which satisfactorily performs such a function in the presence of a color developability-improving agent.

Suitable examples of the color developers are 1,1-bis(4-hydroxyphenyl)ethane, 1,1-bis(4-hydroxyphenyl)propane, 1,1-bis(4-hydroxyphenyl)butane, 1,1-bis(4-hydroxyphenyl)-2-methylpropane, 2,2-bis(4-hydroxyphenyl)propane, 2,2-bis(2 chloro-4-hydroxyphenyl)propane, 2,2-bis(3-methyl-4-hydroxyphenyl)propane, 2,2-bis(4-hydroxyphenyl)heptane, 2,2-bis( 4-hydroxyphenyl)hexane, 2-methyl-3,3-bis(4-hydroxyphenyl)butane, 2-methyl-4,4-bis(4-hydroxyphenyl)pentane, 2-methyl-5,5-bis(4-hydroxyphenyl)hexane, α,α-bis(4 -hydroxyphenyl)ethylbenzene, 2,2-bis(4-hydroxy-3,5 -dimethylphenyl)propane, 2,2-bis(4-hydroxy-2 -methylphenyl)propane, 2,2'-(3-hydroxyphenyl-4' -hydroxyphenyl)propane, 2,2-bis(3,5-dichloro-4-hydroxyphenyl)propane, 2,2-bis(4-hydroxyphenyl)pentane, 2,2-bis( 4-hydroxyphenyl)butane, 2,2-bis(4-hydroxyphenyl)octane, 2,2-bis(4-hydroxyphenyl)hexafluoropropane, 1,1-bis(4-hydroxyphenyl)methane, 1,1-bis(4-hydroxyphenyl-)cyclohexane, 1,1-bis(4-hydroxyphenyl)-2-ethylhexane,2,2-bis(4-hydroxy-3,5-dichlorophenyl)propane, 1,1-bis(2,6-dimethyl-4-hydroxyphenyl)methane, 1,1-bis(2-hydroxy-4-chlorophenyl)methane, 1,1-bis(2-hydroxy-4-methyl-6 -t-butylphenyl)methane,1,1-bis(2-hydroxy-4-methylphenyl-)methane, 1,2-bis(4-hydroxy-2-methylphenyl)ethane, 1,1-bis(4-hydroxy-2 -isopropylphenyl)cyclohexane, 1,1,1-tris(4-hydroxyphenyl)methane, 1-(4-hydroxyphenyl)-1,1-bis(4-hydroxy-3-methylphenyl)methane, 1-(4-hydroxyphenyl)-1,1-bis(4-hydroxy- 3,5-dimethylphenyl)methane,1,1,1-tris(4-hydroxyphenyl)ethane, 4-[4-{1,1-bis(4-hydroxyphenyl)}ethyl]-α,α-dimethylbenzylphenol, bis(4-hydroxyphenyl)acetic acid, methyl bis(4-hydroxyphenyl)acetate, butyl bis(4-hydroxyphenyl)acetate, benzyl bis(4-hydroxyphenyl)acetate, 2,2-bis(4-hydroxyphenyl)propionic acid, methyl 2,2-bis(4-hydroxyphenyl)propionate, ethyl 2,2-bis(4-hydroxyphenyl)propionate, 3,3-bis(4-hydroxyphenyl)butanoic acid, 4,4-bis(4-hydroxyphenyl)pentanoic acid, α,α-bis(4 -hydroxyphenyl)-1,4-dimethylbenzene, α,α-bis(4-hydroxyphenyl)- 1,4-diisopropylbenzene, α,α-bis(3,4-dihydroxyphenyl)-1,3-diisopropylbenzene, α,α-bis(4-hydroxyphenyl)-1,3-diisopropylbenzene, bis(4-hydroxyphenyl)sulfide, N-(p-toluenesulfonyl)-N-phenylurea, bis(4-hydroxy-3-methylphenyl)sulfide, bis(3-methyl-4-hydroxy-6-t-butylphenyl)sulfide,bis( 3,6-dimethyl-4-hydroxyphenyl)sulfide, bis(4-hydroxyphenyl)sulfone, (4-hydroxyphenyl-4' -isopropyloxyphenyl)sulfone, (3,4-dihydroxyphenyl-4' -methylphenyl)sulfone, bis(3-allyl-4-hydroxyphenyl)sulfone, bis(4-hydroxyphenylthioethoxy)methane, 1,2-bis(4 -hydroxyphenylthioethoxy)ethane, 1,5-bis(4-hydroxyphenylthio)-3 -oxapentane, bis(4-hydroxyphenyl) ether, 4,4' -dihydroxybenzophenone, 4,4'-dihydroxydiphenyl, 2,2' -dihydroxydiphenyl, p-phenylphenol, α-naphthol, γ-naphthol, 2,5 -di-t-butyl-p-cresol, 2-t-butyl-p-cresol, 2,6-di-t-butylphenol, p-methylphenol, phloroglucin, pyrogallol, 4-t-octylcatechol, hydroquinone, resorcin, catechol, 4-hydroxyacetophenone, p-t-butylphenol, thymol, 3,5-xylenol, gallic acid, lauryl gallate, stearyl gallate, salicylic acid, salicylic acid anilide, m-hydroxybenzoic acid, p-hydroxybenzoic acid, methyl p-hydroxybenzoate, benzyl p-hydroxybenzoate, ethyl p-hydroxybenzoate, butyl p-hydroxybenzoate, tolylmethyl p-hydroxybenzoate, phenethyl p-hydroxybenzoate, phenyl p-hydroxybenzoate, 2-hydroxy-p-toluylic acid, 1-hydroxy-2-naphthoic acid, dimethyl 3-hydroxy-o-phthalate, 3-phenylsalicylic acid, and methyl 3,5-di-t-butylsalicylate.

Preferred of them are 2,2-bis(4-hydroxyphenyl)propane, 2-methyl-4,4-bis(4-hydroxyphenyl)pentane, 4-hydroxyphenyl-4' -isopropyloxyphenyl)sulfone, bis(3-allyl-4 -hydroxyphenyl)sulfone, and butyl bis(4-hydroxyphenyl)acetate.

These color developers may be used either singly or in combination of two or more thereof.

The color developers are used in a total amount usually of from 10 to 1000 parts and preferably of from 100 to 500 parts, by weight per 100 parts by weight of the color formers.

If desired, the color developability-improving agent according to the present invention may be used in combination with other known color developability-improving agents. The color developability-improving agents are used in a total amount usually of from 1 to 1000 parts, and preferably of from 30 to 1000 parts, by weight per 100 parts by weight of the color developers.

All the color formers, color developers, and color developability-improving agents are used in the form of fine particles, and preferably microfine particles having a diameter of not larger than 5 μm, particularly not larger than 2 μm.

The thermosensitive recording medium of the present invention can be prepared by generally known various methods. Usually, a color former, a color developer, and a color developability-improving agent are separately finely dispersed in water or a solvent together with a binder resin by means of a grinding machine, such as a ball mill or a sand grinder. The color developability-improving agent may previously be incorporated into the color former and/or the color developer. The resulting dispersions are mixed together at a prescribed ratio, and the thus prepared coating composition is coated on a substrate with an applicator, such as an air knife coater, a blade coater or a reverse roll coater.

The binder resin to be used for the preparation of the coating composition includes polyvinyl alcohol, methyl cellulose, hydroxyethyl cellulose, carboxymethyl cellulose, methoxy cellulose, ethyl cellulose, casein, starch, gelatin, styrene-maleic acid copolymer, polyacrylic acid, polyvinylpyrrolidone, isobutylene-maleic acid copolymer, polyvinyl acetate, an ethylene-vinyl acetate copolymer, a styrene-butadiene copolymer, a styrene-butadiene-acrylonitrile copolymer, a vinyl chloride-vinyl acetate copolymer, polyacrylate, polyacrylamide, polyester resins, polyurethane resins, polyolefin resins, and alkyd resins.

If desired, the coating composition may contain compounding additives for improving various properties, such as stabilizers (e.g., hindered phenols), ultraviolet absorbents (e.g., benzophenone derivatives and triazole compounds), lubricants (e.g., polyethylene wax and paraffin wax), water resistance-imparting agents, and the like. The coating composition may further contain dispersants for assisting various components to be dispersed in water or a solvent.

The coating composition is coated on a substrate usually to a dry weight of from 2 to 12 g per $m^2$ followed by drying at a temperature of from room temperature to about 50° C. to form a thermosensitive recording layer.

Paper is generally employed as a substrate. Besides paper, synthetic resin sheets, nonwoven fabric sheets, etc. may also be used.

The present invention will now be illustrated in greater detail by way of Preparation Examples, Examples, and Comparative Examples, but the present invention should not be construed as being limited thereto. All the percents and parts are given by weight unless otherwise indicated.

PREPARATION EXAMPLE 1

In 150 parts of toluene were dissolved 33.9 parts of di-p-chlorobenzyl oxalate (hereinafter abbreviated as DBO-C) (melting point (hereinafter abbreviated as mp): 118° C.) and 27.0 parts of dibenzyl oxalate (hereinafter abbreviated as DBO) (mp: 80° C.) at 100° C. After cooling, the precipitate was collected by filtration to obtain 46 parts of solid solution (1) (mp: 101° C.).

The powder X-ray diffraction pattern each of solid solution (1), DBO, DBO-C and a mere mixture of DBO and DBO-C are shown in FIGS. 1 to 4, respectively. The diffraction pattern of solid solution (1) shown in FIG. 1 had intense peaks at angles of diffraction (2θ) of 5.37° and 16.05° and was different from any of those of FIGS. 2 to 4. The diffraction pattern of the mere mixture of DBO and DBO-C roughly corresponded to FIG. 2 superimposed over FIG. 3

PREPARATION EXAMPLE 2

A mixture of 33.9 parts of DBO-C and 27.0 parts of DBO was heated to melt, followed by cooling. The resulting solid was ground. The grinds were washed with 100 parts of methanol to obtain 60 parts of solid solution (1') (mp: 101° C.).

The powder X-ray diffraction pattern of solid solution (1') was the same as FIG. 1.

PREPARATION EXAMPLE 3

In the same manner as in Preparation Example 1, 51 parts of solid solution (9) (mp: 87° C.) was obtained from 25.8 parts of p-(4-methylbenzyl)biphenyl (mp: 87° C.) and 27.9 parts of p-(4-chlorobenzyl)biphenyl (mp: 96° C.).

The powder X-ray diffraction pattern of solid solution (9) showed intense peaks at angles of diffraction (2θ) of 19.22°, 24.80°, 21.90°, 22.08°, and 21.54°, differing from either of those of the individual starting components.

PREPARATION EXAMPLE 4

In the same manner as in Preparation Example 1, 44 parts of solid solution (13) (mp: 79° C.) was obtained from 21.4 parts of diphenoxyethane (mp: 96° C.) and 24.2 parts of ethylene glycol di-m-tolyl ether (mp: 98° C.).

The powder X-ray diffraction pattern of solid solution (13) showed intense peaks at angles of diffraction (2θ) of 6.80°, 20.50°, 7.49°, 22.96°, and 26.42°, differing from either of those of the individual starting components.

PREPARATION EXAMPLES 5 TO 14

Solid solutions (2) to (8) and (10) to (12) were obtained from the components shown in Table 1 below. The yield, melting point, and the angles of diffraction at main peaks in the powder X-ray diffraction pattern of each solid solution are shown in the Table.

The melting point and the angles of diffraction at main peaks in the powder X-ray diffraction pattern of each starting component are shown in Table 2 below.

Abbreviations used in Tables 1 and 2 have the following meanings.

DBO: Dibenzyl oxalate

DBO-M: Di-p-methylbenzyl oxalate

DBO-C: Di-p-chlorobenzyl oxalate

DPG: Diphenacyl glutarate

DPTP: Diphenacyl thiodipropionate

PBBP: p-Benzylbiphenyl

PBBP-M: p-(4-Methylbenzyl)biphenyl

PBBP-C: p-(4-Chlorobenzyl)biphenyl

BON: β-Benzyloxynaphthalene
BON-M: β-(4-Methylbenzyl)oxynaphthalene
BON-C: β-(4-Chlorobenzyl)oxynaphthalene
DPE: Diphenoxyethane
EGTE: Ethylene glycol di-m-tolyl ether

TABLE 1

| Prepn. Example No. | Component 1 (part) | Component 2 (part) | Component 3 (part) | Solid Solution | Yield (part) | Melting Point (°C.) | Angles of Diffraction (2θ) at Main Diffraction Peaks in he Order of Intensity (°) |
|---|---|---|---|---|---|---|---|
| 5 | DBO-C (33.9) | DBO-M (29.8) | | (2) | 63 | 139 | 15.06, 5.04, 20.13 |
| 6 | DBO (27.0) | DBO-M (29.8) | | (3) | 55 | 71 | 4.94, 5.77, 15.02, 17.35, 10.00 |
| 7 | DPG (36.8) | DBO-M (29.8) | | (4) | 64 | 92 | 4.96, 14.98, 18.93, 20.82, 9.98, 14.53, 24.99, 18.25, 9.10 |
| 8 | DPTP (27.8) | DPG (24.5) | | (5) | 50 | 92 | 3.98, 7.93, 15.88 |
| 9 | DBO (18.0) | DBO-C (22.6) | DBO-M (19.9) | (6) | 58 | 95 | |
| 10 | PBBP (24.4) | PBBP-M (25.8) | | (7) | 49 | 73 | 19.58, 21.14, 21.96 |
| 11 | PBBP (24.4) | PBBP-C (27.9) | | (8) | 51 | 77 | 20.18, 19.48, 25.94, 19.40, 8.50, 16.86, 12.94 |
| 12 | BON (23.4) | BON-M (24.8) | | (10) | 46 | 82 | 18.82, 19.62, 18.58, 23.78, 6.46, 14.92 |
| 13 | BON-M (24.8) | BON-C (26.9) | | (12) | 50 | 105 | 11.84, 6.00, 11.64 |
| 14 | BON (23.4) | BON-C (26.9) | | (11) | 49 | 90 | 18.90, 19.70, 24.00 |

TABLE 2

| Component | Melting Point (°C.) | Angles of Diffraction (2θ) at Main Diffraction Peaks in the Order of Intensity (°) |
|---|---|---|
| DBO | 80 | 17.29, 5.75 |
| DBO-M | 102 | 5.09, 14.97, 10.04, 20.10, 46.14 |
| DBO-C | 118 | 15.31, 5.17, 46.91 |
| DPG | 105 | 18.99, 20.88, 14.60, 6.79, 25.06, 17.55 |
| DPTP | 106 | 4.07, 8.02, 21.57, 15.97, 19.98 |
| PBBP | 86 | 19.20, 19.72, 23.44, 21.66 |
| PBBP-M | 87 | 19.44, 23.38, 23.60, 19.80, 19.14 |
| PBBP-C | 96 | 19.44, 21.06 |
| BON | 101 | 20.00, 19.14, 24.52, 18.88, 6.86 |
| BON-M | 94 | 6.02, 11.00, 20.84, 20.80, 22.86 |
| BON-C | 113 | 24.38, 11.52, 20.34 |
| DPE | 96 | 7.45, 15.07, 22.67 |
| EGTE | 98 | 13.39, 6.50, 20.15 |

EXAMPLE 1

| Liquid A (Color Former Dispersion): | |
|---|---|
| 3-(N-Methyl-N-isoamyl)-6-methyl-7-anilinofluoran | 1.0 part |
| Solid solution (1) | 2.0 parts |
| 10% Polyvinyl alcohol aqueous solution | 3.0 parts |
| Water | 5.0 parts |
| Total: | 11.0 parts |

| Liquid B (Color Developer Dispersion): | |
|---|---|
| 2,2-Bis(4-hydroxyphenyl)propane | 3.0 parts |
| Calcium carbonate | 3.0 parts |
| Zinc stearate | 0.5 part |
| 10% Polyvinyl alcohol aqueous solution | 7.0 parts |
| Water | 10.0 parts |
| Total: | 23.5 parts |

Liquids A and B were separately prepared by means of a paint conditioner.

11.0 Parts of liquid A and 23.5 parts of liquid B were mixed to prepare a thermosensitive coating composition. The resulting coating composition was coated on fine paper having a basis weight of 64.5 g/m$^2$ to a dry weight of 8 g/m$^2$ followed by drying to obtain a thermosensitive recording medium.

EXAMPLES 2 TO 13

A thermosensitive recording medium was prepared in the same manner as in Example 1, except for replacing solid solution (1) used in liquid A with each of solid solutions (2) to (13).

EXAMPLES 14 TO 16

A thermosensitive recording medium was prepared in the same manner as in Example 1, except for replacing 3 -(N-ethyl-N-isoamylamino)-6-methyl-7-anilinofluoran used in liquid A with 3-(N,N-diethylamino)-6-methyl-7-anilinofluoran (Example14), 3 -(N,N-dibutylamino)-6-methyl-7-anilinofluoran (Example 15) or 3 -(N-methyl-N-cyclohexylamino)-6-methyl-7-anilinofluoran (Example 16).

EXAMPLES 17 TO 20

A thermosensitive recording medium was prepared in the same manner as in Example 1, except for replacing 2,2-bis(4 -hydroxyphenyl)propane used in liquid B with 2-methyl-4, 4-bis(4 -hydroxyphenyl)pentane (Example 17), (4-hydroxyphenyl-4' -isopropyloxyphenyl)sulfone (Example 18), bis(3-allyl-4 -hydroxyphenyl)sulfone (Example 19) or butyl bis(4 -hydroxyphenyl)acetate (Example 20).

COMPARATIVE EXAMPLE 1

A thermosensitive recording medium was prepared in the same manner as in Example 1, except for replacing solid solution (1) used in liquid A with a mere mixture of the crystals of the same components in the same ratio as used in solid solution (1).

COMPARATIVE EXAMPLES 2 TO 5

A thermosensitive recording medium was prepared in the same manner as in Example 2, 3, 4 or 5, except for replacing solid solution (2), (3), (4) or (5) used in liquid A with a mere mixture of the crystals of the same components in the same ratio as used in solid solution (2), (3), (4) or (5), respectively.

COMPARATIVE EXAMPLES 6 TO 17

A thermosensitive recording medium was prepared in the same manner as in Example 1, except for replacing solid solution (1) used in liquid A with a single component crystal shown in Table 4 below.

Each of the thermosensitive recording media prepared in Examples 1 to 20 and Comparative Examples 1 to 17 was evaluated for color developing sensitivity, static color developability, image stability, and stability before recording according to the following test methods.

1) Color Developing Sensitivity:

Thermosensitive recording was carried out on a sample medium using a thermal head printer ("Model MSI" manufactured by Okura Denki Co., Ltd.) at a pulse width varying from 0.1 to 1.0 msec. The density of the thus developed color was measured with a Macbeth densitometer "RD-918". The pulse width at which the color density reached 1.0 was obtained from a color density/pulse curve. Color developing sensitivity of the sample was evaluated from that pulse width according to the following standard (the smaller the pulse width, the higher the sensitivity).

| Standard of Evaluation: | |
|---|---|
| Excellent . . . | 0.39 or more and less than 0.47 |
| Good . . . | 0.47 or more and less than 0.52 |
| Poor . . . | 0.52 or more |

2) Static Color Developability:

Thermosensitive recording was carried out on a sample medium using a heat gradient testing machine manufactured by Toyo Seiki Co., Ltd. with the hot plate temperature being varied from 50° to 120° C., and the density of the thus developed color was measured with RD-918. The static color developability was evaluated from the hot plate temperature at which the color density reached 1.0 (the higher the temperature, the higher the static color developability) according to the following standard.

| Standard of Evaluation: | |
|---|---|
| Excellent . . . | 80° C. or higher |
| Good . . . | higher than 70° C. and lower than 80° C. |
| Poor . . . | 70° C. or lower |

3) Image Stability:

A sample medium on which thermosensitive recording had been conducted was preserved at 60° C. and 30% RH for 24 hours, and a percent retention of the initial density ranging from 0.6 to 1.2 was obtained. The image stability was evaluated from the percent retention according to the following standard.

| Standard for Evaluation: | |
|---|---|
| Excellent . . . | 90% or more |
| Good . . . | 80% or more and less than 90% |
| Poor . . . | 70% or more and less than 80% |

4) Stability Before Recording:

Thermosensitive recording was conducted on a sample recording medium having been preserved at 60° C. and 30% RH for 24 hours, and the ratio of the developed color density to the color density obtained by the medium before preservation ranging from 0.6 to 1.2 was calculated. The stability of the color developing performance before recording was evaluated therefrom according to the following standard.

| | |
|---|---|
| Excellent . . . | 90% or more |
| Good . . . | 80% or more and less than 90% |
| Poor . . . | 70% or more and less than 80% |

The results of Examples 1 to 20 are shown in Table 3, and those of Comparative Examples 1 to 17 are shown in Table 4. In the Tables, color formers and color developers used are expressed by the following symbols.

Color Formers:

a: 3-(N-Methyl-N-isoamylamino)-6-methyl-7-anilinofluoran b: 3-(N,N-Diethylamino)-6-methyl-7-anilinofluoran c: 3-(N,N-Dibutylamino)-6-methyl-7-anilinofluoran d: 3-(N-Methyl-N-cyclohexylamino)-6-methyl-7 -anilinofluoran .

Color Developers:

a: 2,2-Bis (4-hydroxyphenyl)propane b: 2-Methyl-4,4-bis(4-hydroxyphenyl)pentane c: 4-Hydroxyphenyl-4'-isopropyloxyphenylsulfone d: Bis(3-allyl-4-hydroxyphenyl)sulfone e: Butyl bis(4-hydroxyphenyl)acetate

TABLE 3

| Example No. | Solid Solution | Color Former | Color Developer | Color Developing Sensitivity | Static Color Development | Color Image Stability | Stability Before Recording |
|---|---|---|---|---|---|---|---|
| 1 | (1) | a | a | good | excellent | good | excellent |
| 2 | (2) | a | a | good | excellent | good | good |
| 3 | (3) | a | a | excellent | good | good | good |
| 4 | (4) | a | a | good | excellent | good | good |
| 5 | (5) | a | a | excellent | good | good | good |
| 6 | (6) | a | a | good | good | excellent | good |
| 7 | (7) | a | a | excellent | good | good | good |
| 8 | (8) | a | a | excellent | good | good | good |
| 9 | (9) | a | a | good | good | good | good |
| 10 | (10) | a | a | excellent | good | good | good |
| 11 | (11) | a | a | good | good | good | good |
| 12 | (12) | a | a | good | good | good | good |
| 13 | (13) | a | a | good | good | good | good |
| 14 | (1) | b | a | good | good | good | excellent |
| 15 | (1) | c | a | good | excellent | good | excellent |
| 16 | (1) | d | a | good | good | good | excellent |
| 17 | (1) | a | b | good | excellent | good | good |
| 18 | (1) | a | c | good | good | good | good |
| 19 | (1) | a | d | good | excellent | good | excellent |
| 20 | (1) | a | e | good | excellent | good | good |

TABLE 4

| Compar. Example No. | Color Developability Improving Agent | Color Former | Color Developer | Color Developing Sensitivity | Static Color Development | Color Image Stability | Stability Before Recording |
|---|---|---|---|---|---|---|---|
| 1 | DBO-C + DBO | a | a | good | poor | poor | excellent |
| 2 | DBO-C + DBO-M | a | a | poor | excellent | good | excellent |
| 3 | DBO-M + DBO | a | a | excellent | poor | poor | good |
| 4 | DPG + DBO-M | a | a | good | good | poor | poor |
| 5 | DPTP + DPG | a | a | good | poor | poor | poor |
| 6 | DBO | a | a | excellent | poor | poor | excellent |
| 7 | DBO-C | a | a | poor | excellent | good | excellent |
| 8 | DPG | a | a | poor | good | poor | good |
| 9 | DPTP | a | a | poor | good | poor | good |
| 10 | PBBP | a | a | good | good | poor | poor |
| 11 | PBBP-M | a | a | good | good | poor | poor |
| 12 | PBBP-C | a | a | poor | good | good | good |
| 13 | BON | a | a | good | good | poor | poor |
| 14 | BON-M | a | a | good | good | poor | poor |
| 15 | BON-C | a | a | poor | good | good | good |
| 16 | DPE | a | a | good | good | good | poor |
| 17 | EGTE | a | a | good | good | good | poor |

On comparing Example 1 and Comparative Examples 6 and 7, it is seen that the thermosensitive recording medium of Example 1 using solid solution (1) composed of DBO and DBO-C as a color developability-improving agent shows marked improvements over the recording medium of Comparative Example 6 using DBO alone in terms of static color developability and image stability and over that of Comparative Example 7 using DBO-C alone in terms of color developing sensitivity. Besides, the recording medium of Example 1 was excellent in stability before recording and thus exhibited well-balanced performance properties.

Similarly, all the thermosensitive recording media obtained in Examples 2 to 20 had well-balanced performance properties among color developing sensitivity, static color developability, image stability, and stability before recording with no prominent disadvantages.

To the contrary, the thermosensitive recording medium of Comparative Example 1, in which the same components as used in solid solution (1) of Example 1 were used in the form of a mere mixture, was inferior to that of Example 1 in static color developability and image preservability. Similarly, the media of Comparative Examples 2 to 5 had poor-balanced performance properties with some disadvantage as compared with the corresponding media of Examples 2 to 5. The recording media of Comparative Examples 6 to 17, in which a single color developability-improving agent was used instead of a solid solution, also had poor-balanced performance properties with some disadvantage as compared with those of Examples 1 to 13.

Thus, the thermosensitive recording medium according to the present invention exhibits well-balanced performance properties among color developing sensitivity, static color developability, image stability and stability before recording without suffering from appreciable defects.

While the invention has been described in detail and with reference to specific examples thereof, it will be apparent to one skilled in the art that various changes and modifications can be made therein without departing from the spirit and scope thereof.

What is claimed is:

1. A thermosensitive recording medium comprising a thermosensitive recording layer containing an electron-donating color forming substance, an electron-accepting substance, and a color developability-improving agent, wherein said color developability-improving agent is a mixture composed of two or more compounds selected from the group consisting of aliphatic dibasic acid esters, benzylbiphenyls, benzyloxynaphthalenes and ethylene glycol diphenyl ethers and contains at least one compound having color developability-improving action, said mixture being a solid solution having a single intrinsic melting point of not less than room temperature.

2. The thermosensitive recording medium as claimed in claim 1, wherein said color developability-improving agent is a solid solution having a melting point of not less than 60° C.

3. The thermosensitive recording medium as claimed in claim 1, wherein said color developability-improving agent is a solid solution having a melting point of not less than 90° C.

4. The thermosensitive recording medium as claimed in claim 1, wherein said color developability-improving agent is a solid solution composed of at least two compounds selected from aliphatic dibasic acid esters.

5. The thermosensitive recording medium as claimed in claim 1, wherein said color developability-improving agent is a solid solution composed of at least two compounds selected from benzylbiphenyls.

6. The thermosensitive recording medium as claimed in claim 1, wherein said color developability-improving agent is a solid solution composed of at least two compounds selected benzyloxynaphthalenes.

7. The thermosensitive recording medium as claimed in claim 1, wherein said color developability-improving agent is a solid solution composed of at least two compounds selected ethylene glycol diphenyl ethers.

8. The thermosensitive recording medium as claimed in claim 1, wherein the two or more compounds in said solid solution are present at an equimolar ratio.

* * * * *